US010045586B2

(12) United States Patent
Almaguer et al.

(10) Patent No.: US 10,045,586 B2
(45) Date of Patent: Aug. 14, 2018

(54) PROTECTIVE TOE CAP FOR INDUSTRIAL FOOTWEAR

(71) Applicant: Internacional de Calzado Ten Pac, S.A. de C.V., Pachuca (MX)

(72) Inventors: Roberto Munoz Almaguer, Leon (MX); Fernando Chico Ruiz, Leon (MX); Carlos Armando Fuentes Aragon, Leon (MX); Roberto Zitzumbo Guzman, Leon (MX); Ramon Alberto Ayala Medina, Leon (MX); Constantino Vidal Guerrero, Leon (MX)

(73) Assignee: Internacional de Calzado TEN PAC, S.A. de C.V. (MX)

( * ) Notice: Subject to any disclaimer, the term of this patent is extended or adjusted under 35 U.S.C. 154(b) by 442 days.

(21) Appl. No.: 14/149,956

(22) Filed: Jan. 8, 2014

(65) Prior Publication Data

US 2014/0115795 A1 May 1, 2014

Related U.S. Application Data

(62) Division of application No. 12/734,919, filed as application No. PCT/MX2008/000074 on Jun. 13, 2008, now abandoned.

(30) Foreign Application Priority Data

Dec. 5, 2007 (MX) ..... MX/a/2007/015351

(51) Int. Cl.
*A43B 13/38* (2006.01)
*A43B 23/08* (2006.01)
(Continued)

(52) U.S. Cl.
CPC ..... *A43B 7/32* (2013.01); *A43B 23/082* (2013.01); *A43B 23/087* (2013.01); *A43D 1/08* (2013.01)

(58) Field of Classification Search
CPC ..... A43B 7/32; A43B 23/087; A43B 23/082; A43C 1/08
(Continued)

(56) References Cited

U.S. PATENT DOCUMENTS 4,884,309 A * 12/1989 Shafir ..... A43D 1/04 12/1 R
5,074,060 A 12/1991 Brncick et al.
(Continued)

FOREIGN PATENT DOCUMENTS

ES 1065081 U 6/2007
FR 2693087 A1 1/1994
(Continued)

*Primary Examiner* — Timothy K Trieu
(74) *Attorney, Agent, or Firm* — Dennis L. Cook, Esq.; Juan Ferrer, Esq.

(57) ABSTRACT

The invention relates to a one-piece protective toe cap for safety footwear, forming a concave frame consisting of a front wall with connected side walls, the upper edges of which are joined by a concave surface along the profile of the last. The contour or edge of the flange of the toe cap is provided with a recess in order to house a tab and provide comfort, as well as improving the appearance of the footwear (not shown in these documents). The design withstands impact tests of approximately 101.7 to 146.7 Joules (10.4 to 14.95 kgf-m), leaving clearance of approximately 11 mm to 14 mm in the capped shoe and not only at the tip of the cap.

10 Claims, 6 Drawing Sheets

(51) Int. Cl.
*A43B 7/32* (2006.01)
*A43D 1/08* (2006.01)

(58) Field of Classification Search
USPC ..... 12/146 R, 146 L, 146 M, 142 B, 147 B; 36/77 R, 77 M; 382/100
See application file for complete search history.

(56) References Cited

U.S. PATENT DOCUMENTS

| | | | | |
|---|---|---|---|---|
| 5,237,520 | A * | 8/1993 | White | A43D 1/025 12/142 N |
| 5,671,055 | A * | 9/1997 | Whittlesey | A43D 1/025 33/3 R |
| 2007/0068044 | A1* | 3/2007 | Ikegami | A43B 23/087 36/77 R |
| 2009/0013555 | A1* | 1/2009 | Vitulli | A43B 7/12 36/10 |
| 2009/0073162 | A1* | 3/2009 | Waatti | A43D 3/02 345/419 |

FOREIGN PATENT DOCUMENTS

| | | | |
|---|---|---|---|
| FR | 2882231 | A3 | 8/2006 |
| JP | 59162003 | U | 10/1984 |

* cited by examiner

PROTECTIVE TOE CAP FOR INDUSTRIAL FOOTWEAR

CROSS-REFERENCE TO RELATED APPLICATION

The present application claims the benefit of previously filed co-pending patent applications, application No. MX/a/2007/015351, PCT/MX2008/000074, and U.S. Ser. No. 12/734,919, the contents of which are hereby incorporated by reference.

FIELD OF THE INVENTION

The invention addresses the need to protect a worker who is performing a productive activity in industry, a one-piece toe cap has been designed for industrial protective footwear in which said toe cap is specifically designed to the protection of the five digits of the foot against impact and crushing by falling objects. The invention relates to a one-piece toe cap for safety footwear that forms a concave 180° frame that houses an internal cavity supported by a horizontal interior flange that covers the entire internal part of the perimeter of the toe cap 5 to 7 mm in width, the concave frame is composed of a front wall with side walls connected to both sides and whose upper edges are joined by a concave surface following the profile of the last; the toe cap is previously prepared by the attachment in its mouth of a strip of synthetic material known as a tab and placed in the footwear through an insertion fitted to the tip of the dressed last (a form that creates the footwear's size, fit and style), meaning by dressed last the prior attachment of an element known as the sole to the bottom part of the last and another element fitted three-dimensionally to the tip of the last known as the lining, the attachment of the toe cap being completed by a layer of material encircling the entire outer surface of the toe cap. The upper surface has an edge on the side opposite the front wall having a recess. Furthermore, the invention relates to a method of calculating and designing a toe cap starting from a last.

BACKGROUND OF THE INVENTION

It is known that the Mexican company FOOTMEX DE MEXICO S.A. de CV. produces a commercial toe cap designed in two alternative materials, which are offered on the market as being economical and high-impact, basing its designs on two toe caps of commercial dimensions known as model 600 and 630.

Mexican utility model No. 796, granted on 13 Jul. 2000 to the company Calzado Van Vien S.A. de C.V., relates to an armored tip for protective footwear, formed by a section in the shape of a hollow semiparabolic arch of high-strength steel sheet, intended to house and protect the tip of the user's foot from forceful impacts, wherein the section itself is folded at its lower end to form a horizontal flange that spans the entire perimeter by the internal part of the tip, and the ends of the inner horizontal flange have a bridge welded to the lower face of the flange, whose purpose is to provide structural support to the armored tip, to prevent its collapsing or flattening under the impact of a force of significant magnitude.

Mexican patent number 225317, dated 4 Jan. 2005, granted to H. H. BROWN SHOE COMPANY, INC., describes a footwear and its method of manufacture. The footwear includes an upper that has a front lining with a tip part arranged along an internal surface of the upper. A relatively rigid front insole part is joined to an inner lining, the length of the front part of the insole being less than the length of the inner lining. The tip portion of the front lining is then sewn to a peripheral edge of the front insole part, the front lining and the front insole part defining a cavity to receive part of the user's foot. A steel tip is then placed basically around the tip part of the front lining.

Spanish utility model No. 1062608 relates to an ergonomical shoe, of the kind incorporating between the leather and the lining, and in the area of the toe and the heel, a rigid front reinforcement and a rear heel reinforcement, which participate both in the armoring of the leather and in the protection of the front foot from outside impacts, characterized in that it incorporates shock absorbing elements in the area of the front and rear reinforcements, adapted to the internal face of the front and rear reinforcement and situated, the same as these, between the leather and the lining, said shock absorbing elements being made of a soft, high-density material, such as a foam of urethane, polyurethane, polyethylene, EVA, latex, silicone or another similar material with adequate density and breathability for the type of footwear.

Spanish utility model No. 1062609 relates to an ergonomical footwear, of the type having between its leather and its lining, and in the area of the tip or toe cap and the heel, a rigid front reinforcement and a rear reinforcement, which participate both in the armoring of the leather and in the protection of the front foot from outside impacts, characterized in that each of these front and rear reinforcement elements has two layers of different density, specifically, an outer layer of very high density, imparting hardness and rigidity to same, and an inner layer of less density, which is softer and more comfortable and which is what will make contact with the foot via the lining of the footwear.

Spanish utility model No. 1065081 describes a reinforcement tip for safety footwear that has an arched configuration that is designed for mounting on the front part of a safety footwear used in certain industries, characterized in that it is comprised of two parts or pieces (1) and (2), the first being rigid, of arched configuration, while the second part or piece (2) is of flexible material, and is joined by injection molding to the rear part of the rigid piece (1), forming a continuity with the latter.

Spanish utility model No. 2105370 describes a tip for a safety shoe or boot, to provide a tip which is light and has sufficient strength the tip is made of a compound material comprising a thermoplastic resin (7) reinforced with fiber and at least one wire mesh (4) that has a size of 7 to 200 reticules and is included in the fiber-reinforced thermoplastic resin. In a preferred embodiment of said Spanish utility model, the fiber-reinforced thermoplastic resin comprises a thermoplastic layer (1) reinforced with long fiber and it has long reinforcement fibers (5) incorporated in it, and a thermoplastic layer (2) reinforced with short fiber that has short reinforcement fibers (6) incorporated in it, and the wire mesh (4) is included in the thermoplastic layer (2) reinforced with short fiber.

The differences lie in the fact that the aforementioned models describe aspects such as the assembly system, some materials of which are composites, and protective inserts in the tip of the foot; even so, they do not define the design and development of a specific toe cap based on an anthropometric study and the parts of the foot to be protected, considering the ergonometric and functional aspects in various activities of the user, nor do they give a rule for evaluation of impact and compression results that they fulfill.

The aforementioned developments describe the use of a bridge that serves basically to anchor the toe cap properly to the construction system; this bridge does not exist in the present invention. The dimensions are not the same (width, height and internal depth). The dimensions of the toe cap of the invention are adapted to the morphology of the worker's foot, and adequate construction materials have been included so as not to take up space from the toe cap which has the necessary space dictated by the dimensions of the foot, considering the movements for the various activities of the user during the performance of his activity. The toe cap of the invention has a recess in the contour or edge of the flange, designed to accommodate a tab and create comfort, as well as improve the appearance of the footwear, and the disclosure of these documents does not show this. The design of the invention withstands impact testing of approximately 101.7 to 146.7 Joules (10.40 to 14.95 kgf-m) and compression of 11,130 to 14,710 Newtons (1135 to 1500 kgf-m), leaving a free height of approximately 11.0 mm to 14.0 mm, in the finished shoe and not only at the point of the toe cap.

The invention relates to a one-piece toe cap for safety and protection footwear, formed by a front wall with lateral walls connected to both sides and whose upper edges are joined to a concave surface and in which the lower edges are provided with a flange providing it with rigidity, anchoring, stability and a base which further minimizes the movement of the toe cap and its sinking into the surface of the sole upon sustaining an impact or compression and at the same time serving to join the toe cap to the sole.

In the case of the present invention, the safety footwear that is worn during work has a toe cap to prevent injury to the front part of the foot, by covering its five toes, from forces of sudden action, such as falling objects. The prior art was researched, without result, for a toe cap that provides coverage and protection to the five toes and that is stable, light, comfortable, and prevents injury to the five toes under a maximum impact, and is easy to manufacture. This need is only met by the toe cap of the present invention, which is made from a single piece, whose material provides resistance to impact and is stable and light. Its design incorporates a broadened end part and an edge in the lower zone, as termination of the front and lateral walls, at the same time providing rigidity to the terminal angle.

The toe cap is of a single piece, without any perforation for means of attachment, with lateral walls and continuous sheet, with a space arrangement sufficient to properly accommodate the five toes and at the same time allow them to flex freely, providing a comfort not offered by the toe caps on the market.

In the present invention, this toe cap is finished in keen edges forming a framework of original design, rigid and resistant to impact forces.

Another advantage is that, being made of a single piece, it facilitates the placement of the out covering material, which can be leather, synthetic, or textile, improving the final appearance of the footwear.

Another advantage is that the toe cap can be fabricated in a single step, and when produced on an industrial scale it provides major economic, technical, protective and hygienic advantages.

Yet another advantage, and being different from the prior art, is that it does not need grooves or bars connected in articulated fashion to secure the toe cap to the bottom sheet, thus avoiding traction forces which result in deformation of the industrial footwear and reduced protection for the foot, and becoming an unwanted risk element, to the contrary of its purpose.

BRIEF SUMMARY OF THE INVENTION

The invention relates to a one-piece protective toe cap for safety footwear, forming a concave frame consisting of a front wall with connected side walls, the upper edges of which are joined by a concave surface along the profile of the last. The contour or edge of the flange of the toe cap is provided with a recess in order to house a tab and provide comfort, as well as improving the appearance of the footwear (not shown in these documents). The design withstands impact tests of approximately 101.7 to 146.7 Joules (10.4 to 14.95 kgf-m), leaving clearance of approximately 11 mm to 14 mm in the capped shoe and not only at the tip of the cap. Therefore one objective of the invention is to start from a last obtained by anthropometric study of the worker wearing the safety and protective footwear, currently being filed for a patent by the same applicant of the present invention, and design, calculate and elaborate a one-piece toe cap to protect the five toes of the foot, defining heights, widths, depths and elements for balanced distribution of impact forces.

A further object is to obtain a toe cap that complies at minimum with the tests of the standard NRF-008-PEMEX-2001, impact strength of 101.7 J (10.4 kgf-m) and compression of 11,130 N (1135 kgf-m).

A further object is to develop a one-piece toe cap that effectively protects the five toes with the maximum possible comfort, not interfering with the free flexing and not promoting deformation of the foot, being ergonomical in accordance with the morphology of the worker wearing the safety and protection footwear.

A further object is to develop a one-piece toe cap or effective protector of the five toes for adequate use as individual protective equipment to reduce the economic and human costs occurring in the country from injuries to the feet of the workers wearing this product.

DESCRIPTION OF THE DRAWINGS

For a fuller understanding of the nature and objects of the invention, reference should be made to the accompanying drawings, in which.

The foregoing views show only the corresponding views of the right foot for simplicity of drawing and explanation of the invention.

DETAILED DESCRIPTION OF THE INVENTION

The toe cap of the present invention has as one of its main characteristics the fact of protecting the five toes.

To cover and protect the five toes, one must take into account the following points during the design and calculation:

1. Respect the line of flexure.
2. Consider the external length of the tab.
3. The anatomical distribution of the heads with the metatarsals.
4. The inclusion of the 5 toes.
5. The displacement of the foot while walking.
6. Thicknesses of the construction materials of the footwear.

Analysis of the zone of flexure of the toes, the position of the metatarsal heads and the foregoing considerations let one establish the anatomical aspects of the foot for the development of a protective toe cap in a specific form that covers the five toes and at the same time provides a sufficient flexing zone so that the toe cap does not strike the metatarsal heads of the foot.

Figure 6:
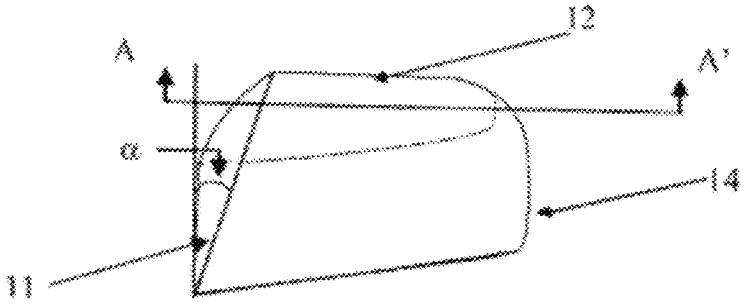
FIG. 6 is a lateral elevation view showing the height and general shape of the toe cap.
Figure 7:
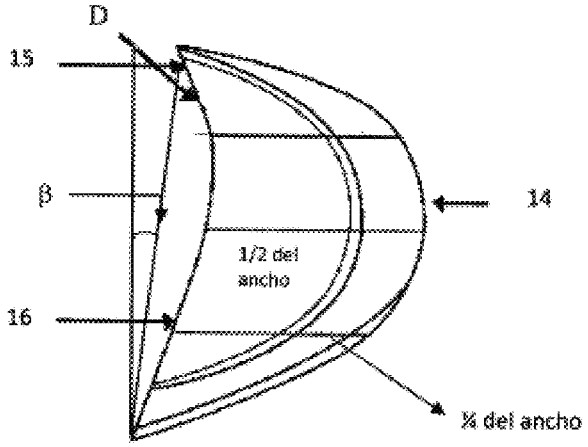
FIG. 7 is a top plan view of the toe cap, showing the angles formed with regard to a straight line of the internal points of the width of the toe cap between the internal and external point equivalent to around 5 degrees as a result of the coverage for the 1st and 5th toes, thereby giving greater coverage to the 5th (little) toe.

It should be pointed out that the rim of the toe cap of the present invention has two angles ($\alpha$, $\beta$), as shown in FIGS. 6 and 7; the toe caps of the prior art do not include these angles, which has the effect of preventing flexure of the foot while at least partly protecting the five toes.

To achieve the objectives of the invention, that is, to obtain a one-piece toe cap protective of the five toes for use in a protective footwear that effectively provides such protection, not causing deformation, free of roughness, edges, points, being ergonomical and at the same time letting the user perform his normal activity exposing him to risks with appropriate protection and of the required degree, the present toe cap is manufactured from materials not having harmful effects on the health.

The toe cap is of a single piece, nonmetallic, although in an alternate modality it can also be manufactured from a metallic material.

Figure 3:
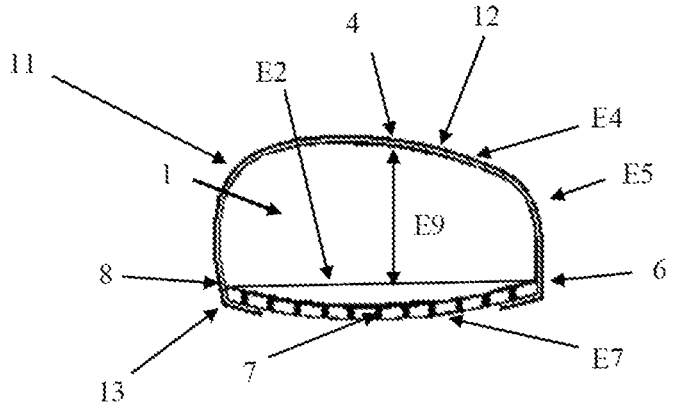
FIG. 3 is a longitudinal sectional view of line D-D' of FIG. 1A.
Figure 8:
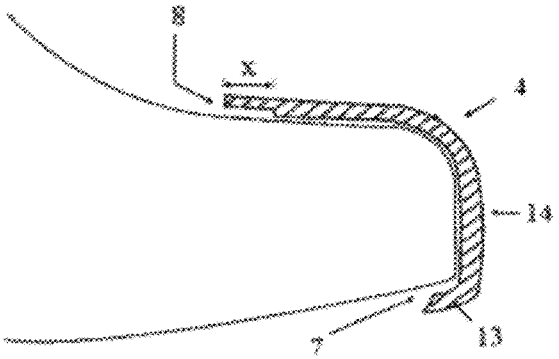
FIG. 8 is a sectional view along the central longitudinal line of the toe cap of FIG. 1A, showing a detail of the step for the tab of the toe cap.
Figure 9:
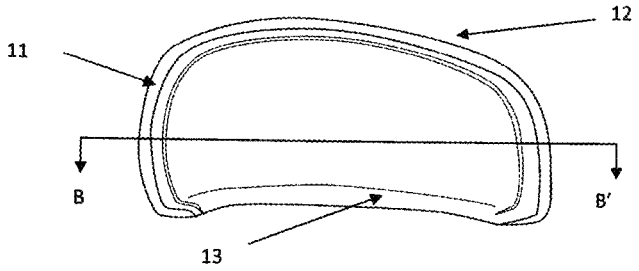
FIG. 9 is a view from the opposite side of the point of the toe cap.
Figure 10:
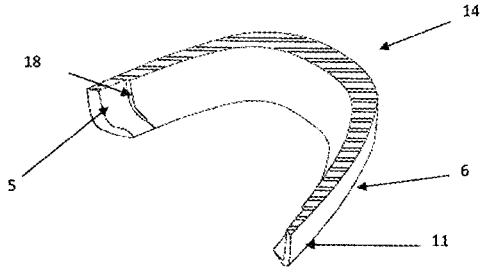
FIG. 10 is an isometric view along line B-B' of FIG. 9.

As can be seen in FIG. 3, the toe cap comprises a rim (11) formed by a front wall (5), lateral walls (6, 8) joined toward the upper part by means of a nonplanar portion of the surface (12). The lower part of the toe cap has a flange (13) which is joined to the shoe via the sole (7). The opposite end of the nonplanar surface (12) terminates in the rear wall (14) (see FIG. 6). This rim (11) recedes from the front wall (5) toward the rear wall (14), along the internal face of the toe cap, to terminate in the step (18) (FIG. 8) at a distance (x) of typically 0.8 to 1.0 cm. FIGS. 8 and 10 are transverse and longitudinal section views showing the step (18).

The rear wall (14) is a semicylindrical wall generally following the shape of a rounded tip, the rim which joins the lateral walls (6, 8), the rear wall (14) and the upper surface (12) is a rounded rim (FIG. 3).

Figure 5:
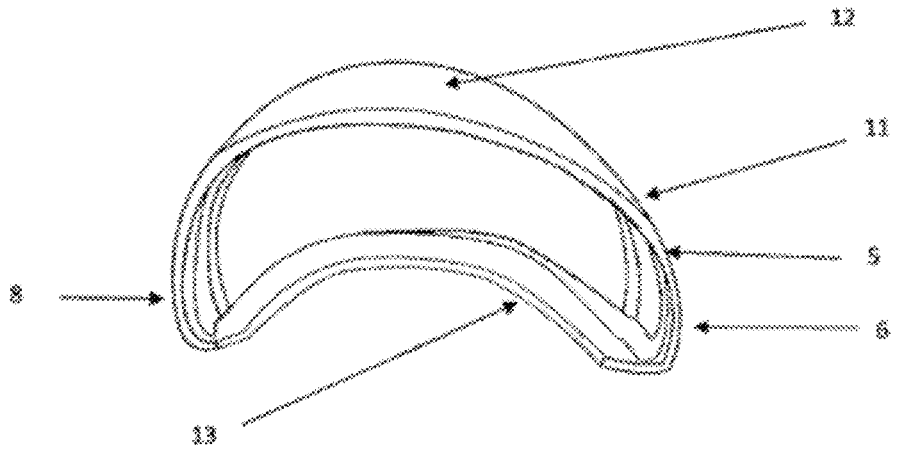
FIG. 5 is a front isometric view of the toe cap, showing its internal arch.

The design of the toe cap of the present invention forms a framework which, owing to its disposition in space and the development of the angles, is extraordinarily rigid and resistant to impacts. Thanks to the design of the toe cap, the elements (4, 6, 8 and 11) and the flange (13) and its ends terminating in a point conduct the force of the impact over the walls and to the sole, preventing the toes from being exposed to the impact. In addition, the flange (13) prevents the penetrating action to the contact surface of toe cap/sole, reducing the risk to the 5 toes of the user of the safety and protection footwear. It also prevents movement of the toe cap at the moment of sustaining an impact or a compression with a force as defined in the aforementioned ranges (FIGS. 3 and 5).

To calculate the shape of the toe cap of the present invention, one uses as the base the last of patent application No. MX/a/2007/003886, whose proprietor is the same as the present application. This last, deriving from an anthropometric study, made possible the perfect adaptation to the morphology of the worker wearing the safety and protection footwear.

Accordingly, the design of the protective toe cap bases the definition of its dimensions on the last corresponding to the size of the footwear. It is not a universal toe cap in the sense of not changing its dimensions with the footwear, but rather its dimensions are modified in accordance with the size of the footwear to which it will be adapted, which is not the case with the toe caps of the prior art.

Figure 1A:
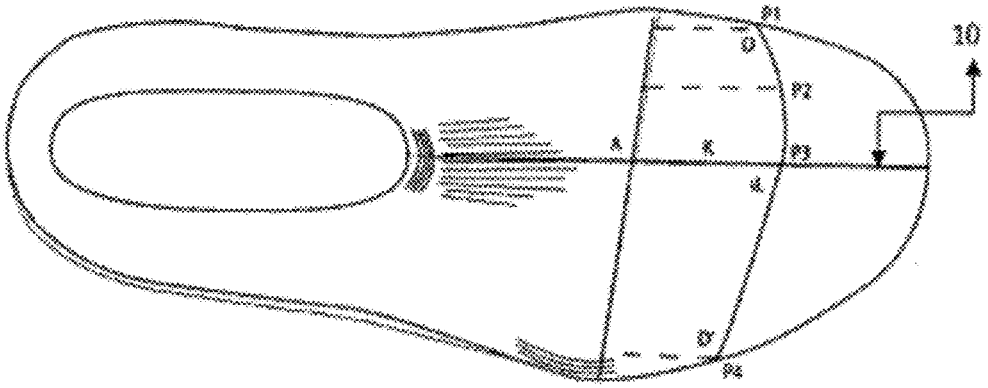
FIG. 1A is a top view showing the line D-D' which is the basis for the design of the toe cap and enables effective protection of the five toes.
Figure 1B:
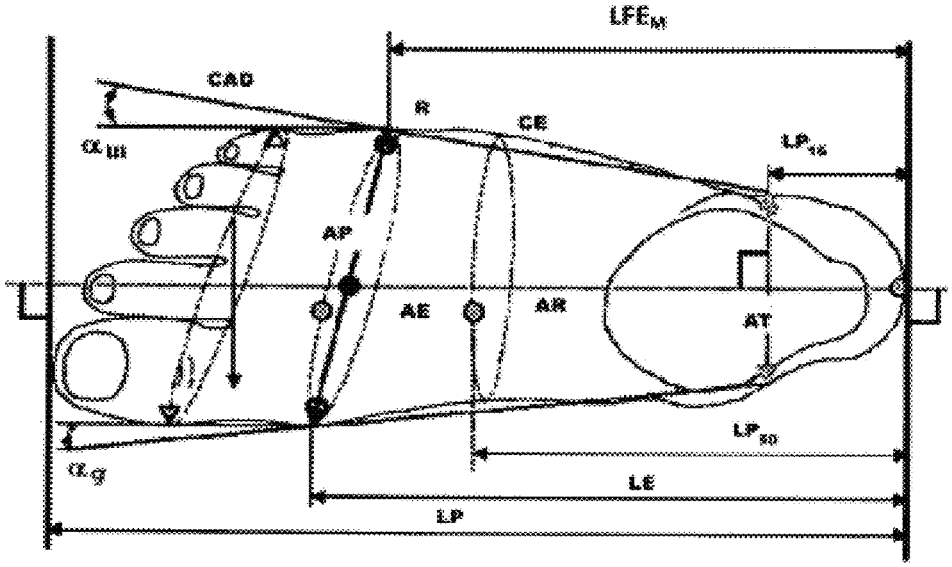
FIG. 1B is a schematic top plan view of the foot indicating the different measurements and parts of same involved in the design of the last and toe cap of the present invention.

The variables that were considered for the development of the industrial footwear last were in general, see FIG. 1B: "recio" (R), width of the foot (AP), instep circumference (CE), heel width (T), instep length (LE), dimensions of the toes, fibular length of instep (LFEm), height of "recio" (AR) (Height of the circumference of the ball of the foot), instep height (AE), big toe angle ($\alpha$g), little toe angle ($\alpha$m), length of foot (LP), instep length (LE), length of foot at 16% (LP16), length of foot at 50% (LP50), a certain tolerance, metatarsal width and length, plantar length and width, tip height, heel width (AT), circumference of the toe area (CAD), heel bulb width, etc.

Additional considerations for the design of the last in the area of the tip that will define the design of the toe cap are: the anatomical distribution of the heads of the metatarsals, the inclusion of the 5 toes, the displacement of the foot while walking, the foot flexure zone. The values obtained in the anthropometric study sample determined the dimensions applied specifically to the tip of the last so that the design of the toe cap will use the dimensions of same as its base.

It is important to note that a study on determining the ability of toe caps to cover or protect the toes found that the designs of the prior art do not protect the five toes, but only four of them, leaving uncovered the little toe, which is also the most fragile toe of the foot. Hence the need to design a toe cap that covers this last toe.

During the research, some inconveniences were encountered, such as the fact that increasing the depth of the toe cap reduced the mobility of the foot, making the use very uncomfortable. Therefore, some additional considerations were taken into account to dimension and design the toe cap of the present invention. Other considerations for the calculation and design of the toe cap are: the thickness of the materials for sole (E7), the thickness of the lining (E5) to be used, thickness of the tab (not shown), as well as the dimensions of the last (1), as shown in FIGS. 2A, 2B, 3 and 8A.

An additional protective space has been added to the last along the length and height in order to provide freedom of movement to the toes and create a grace space in the event of a compression or impact accident to which the toes may be subjected, this consideration being 3 to 7 mm in addition.

There are many other considerations for calculating the final dimensions of the protective toe cap; even so, the most important part for achieving the objective of the present application is the form of the contour of the rim (11) of the toe cap, to calculate which the following was taken into account:

1. The point of depth adequate to the flexure was obtained in addition to the mathematical model by subjecting the industrial shoe to the functions of walking and flexure.

2. The dimensions of the toes, which were determined by using the three-dimensional scanning system known as INFOOT, translating the files by means of an adapter known as LINE CONVERTER to a dimension evaluation system known as RHINOCEROS. The transformation of the information to RHINOCEROS made it possible to evaluate with precision the three-dimensional dimensions of the toes and thus establish the design criteria for the tip of the last and, consequently, those of the toe cap.

The information obtained from the population evaluated by the three-dimensional measurement system using INFOOT is subjected to statistical analysis to determine the trends of the measurements and obtain the most representative ones for the population segments studied.

The development and use of a footwear constructed with the initial mockups of the toe cap and translucent materials making it transparent and the recommendations established in the various studies carried out with regard to the design of the footwear established the criteria for determining the depth measurements of the toe cap or protective tip, such as carrying out various activities with the footwear that might cause discomfort in the foot, such as squatting down to perform an activity, and checking whether the depth of the toe cap is exceeded. In this case, the discomfort produced would be detected in the flexure zone.

3. The width of the one-piece toe cap is provided directly by the measurements produced by the anthropometric study, in which it is possible to establish the measurements of the toes and translate them into the measurements of the last.

4. Starting with the electronic capture of the last by means of the auxiliary design software (known as RHINOCEROS), in which the images of the bodies of the previously designed lasts were captured, this system enables detailed working on the design and measurements of parts and components of interest. In this way, and given that the starting point for the design of the toe cap or protective tip is the last, one first establishes the basic measurements that will correspond to those of the toe cap: width, height and depth.

Once the points on the last have been indicated and identified, a first abstraction of the toe cap is performed, obtaining an image which replicates an exact image of the tip of the last with the dimensions of the desired depth. On the lines defined for the width, height and depth as defined on the last, one determines the additional advantages required to integrate in the design the dimensions and thickness of the sole, tab, and lining.

By means of the electronic file that has been generated for each of the designs and sizes of the toe cap, one can properly establish the established dimensions, which are: interior mark, central mark, exterior mark, height mark and width mark, all these measurements being interior to the toe cap.

5. The width of the toe cap is provided directly with the measurements put out by the anthropometric study, from which it is possible to establish the measurements of the toes in their entirety, in order to translate to the last the location of the metatarsal heads of the five toes one locates the points (g) and (a) (see FIG. 2A), which are the internal and external fibular lengths of the last; these points being joined together to determine the curved line A.

6. In order to cover in the best way the first (big toe) and fifth (little toe) digits of the foot, without interfering with its flexure, 4 the points of digits 1 and 5 on the curve D-D' are projected to the plantar base of the last with an angle of inclination adequate to cover the mentioned digits without causing rubbing in them and to provide greater stability to the toe cap by means of this design, establishing in this way two points on the plantar base of the last that are identified as P and C. The measurement of a straight line that joins points P and C will determine the width of the last for the toe cap (the width of the last determines the width of the toe cap), to this measurement will be added twice the thickness of the lining and twice the thickness of the tab so that the insertion of the toe cap in the assembled footwear is correct.

Electronic Fitting of the Toe Cap Design to the Electronic Last.

Once the adjustments have been made to the image originally abstracted from the last, one verifies that the adapted measurements properly fit the electronic image of the assembled last. In this step, one can evaluate in detail whether the measurements of the designed toe cap coincide with those of the assembled last or, if not, perform corrections for the deviations found and repeat the evaluation, even though due to the precision of the software this is seldom feasible, since the electronic design systems in CAD environments have millimeter precision, as is the case with RHINOCEROS.

It is possible to predict with good precision whether the adjustments applied to the original dimensions of the toe cap will have a correct fit, since one can add to the original body of the last the thickness dimensions of sole, tab and lining and electronically simulate whether the fit will be correct.

Given that the toe caps or protective tips are embodied in three types with respect to their supporting base, it is important to define in the design the type of base that is adequate for operational purposes of the present toe cap; the types of support base are:

1. no flange
2. half flange
3. complete flange.

The toe cap support base selected for the present invention is that with a complete flange (13).

One the final dimensions are in hand and the electronic file has been evaluated, it is sent to a prototyping area where the details are checked in order to:

1. Develop the electronic design program for the design in the numerical control center (CNC).

2. Make adjustments to match up the dimensions of the electronic design of the toe cap with the dimensions of the electronic design of the mold.

3. Calculate the external dimensions required by the design of the toe cap to comply with the specifications of the established standard.

4. Using a trial design, one determines the dimensional variables having a high probability of complying with the results of the experimental design and finally those of the reference standard.

5. One obtains the dimensionality and formulation, as well as all the processing conditions resulting in compliance with the specifications in order to achieve industrial reproducibility of the toe cap.

6. With the certified toe caps, footwear is developed to evaluate two fundamental aspects:

a) Functionality of the design in use, by evaluating the freedom of movements in different positions and activities of the user, without the design in any way interfering with same.

b) Laboratory tests to evaluate the compliance in complete footwear and define whether the toe cap or the construction shape of the footwear need to be adjusted.

Figure 4:
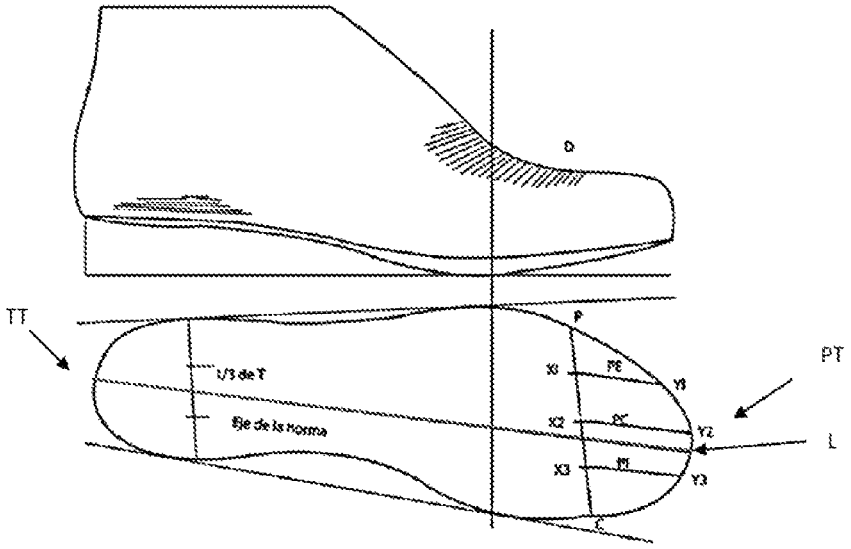
FIG. 4 is a view of the last of the preferred embodiment and its corresponding plan view illustrating measurement points of the toe cap of the present invention, in which one can see the location of the lower line of line D-D', and the line P-C which defines the width of the last for the design of the toe cap.

Determination of the Curvature D-D' of the Rim (11):

To calculate the curvature of the rim (11), defined by the line D-D' (see FIG. 1A), the following procedure was followed:

1. One determines the actual length (10) of the last by placing the central part of the heel and tip on the sole of the last (1) and the central part of the tip of the last; once the points are located, one takes a measurement, following the contours of the plantar shape of the last; in this way, one obtains the value "L" of the last, as shown in FIG. 4.

2. One traces the line of the top central axis, locating the points of the line from the central part of the flat to the central point of the tip of the last.

3. One obtains a value L/6.416 and applies it in the body of the last, measuring from a perpendicular line, traced on edge from the tip of the last and following along the line of the central axis, until the resultant value of L/6.416 is located. In addition, one must consider the value T/3, which should be measured from a straight line parallel to the internal fibular [line] which touches the flexure line point A until it reaches the point defined by L/6.416, so that in this way using (L/6.416, T/3) as coordinates one determines the point P2 as one of the points dictating the curvature D-D' (FIGS. 1A, 1B, 3 and 6).

Considering that:

a) For the fifth digit (little toe) (P4): it is only covered as far as the zone of the nail, equivalent to a quarter of the length of the digit, since to cover a greater zone would create a rubbing effect against the walls of the toe cap with the natural movement of the foot.

b) For the first digit (big toe) (P1): coverage is provided as far as the flexure zone of the second metatarsal to avoid the aforementioned effect.

Tracing a line between P1, P2, P3, and P4, one defines the curvature of the toe cap that will effectively cover the five toes of the foot, respecting the flexure zone.

In keeping with the locations of the points P1 and P4, the following formula was developed to calculate the curvature of the rim (11):

$$K=T/3+5\text{ mm}+10\text{ mm, where:}$$

K is a constant that defines the point coinciding with the central line of the last (10) and with the central line of the curvature of the toe cap. Mathematically, it is defined as the distance A–P3 (see FIG. 1A), which is equal to ⅓ of T+5 mm+10 mm.

T is the width of the heel.

P1 is defined as the point on the curve of the toe cap closest to the line of descent on the last on the lateral wall to the first digit (big toe).

P2 is defined as the maximum point of curvature most pronounced toward the curvature of the last.

P3 is the distance at which the curvature of the toe cap coincides with the central axis of the last.

P4 is the point closest to the line of descent to the zone of the 5th digit (little toe) or external line of the last.

Having defined the elements contained in the formula for K, the formulas for location of P1 to P4 for men will be as follows:

$$P1=K-(0\text{ to }7\text{ mm})$$

$$P2=K+(0\text{ to }6\text{ mm})$$

$$P3=K$$

$$P4=K-(1\text{ to }2\text{ mm}),$$

and for women:

$$P1=K-(2\text{ to }7\text{ mm})$$

$$P2=K-(1\text{ to }3\text{ mm})$$

$$P3=K$$

$$P4=K+(2\text{ to }7\text{ mm}).$$

Figure 2A:
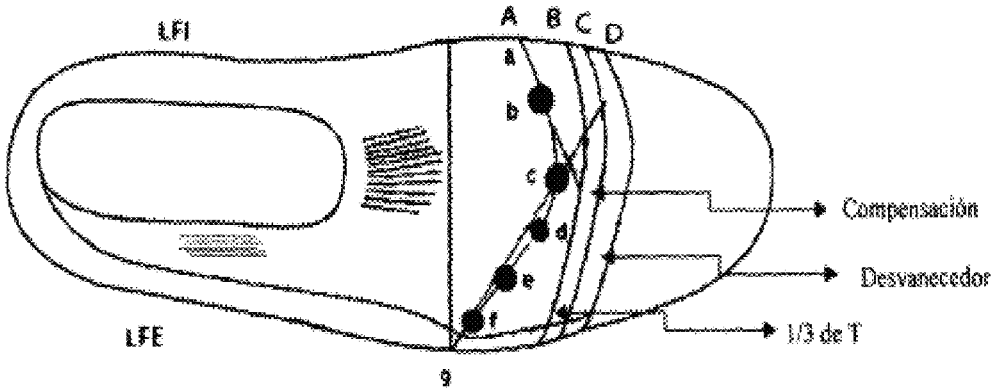
FIG. 2A is a top plan view showing the position of the toe cap with respect to certain points used to determine the design and the dimensions of the toe cap.

For the remaining dimensions, an image editing program was used that made it possible to visualize more objectively the position on the last of the 5 metatarsal heads, adjusting the points a-g as the points which give us the position "A" or initial flexure line, see FIG. 2A.

In the above image, one can observe the position of the metatarsal heads of the skeletal system of the foot (b, c, d, e and f), locating the points of the lines of internal fibular length LFI and external fibular length (LFE), respectively correlating the points ((a) and (g)) and finally joining these points to determine a form with special curvatures, defining the area of flexure on the last.

We now proceeded to determine the following dimensions:

Ia.—Dimensions of the Last in the Zone D-D'

Zone D is the curvature over the last of the toe cap and the height is to be considered at the highest point:

R=maximum height of the last in zone "D" (not considering the camber)

Z=maximum width of the last in the plantar base of the zone "D"

And considering:

Thickness of materials:

From FIG. 3 one finds the measurements

Thickness of sole (E7)

Thickness of lining (E5)

Thickness of the tab (E4)

Then the first dimensional determinations will be:

Width of the toe cap (E2)

Height of toe cap (E9)

Then:

$$(E2)=Z+2(E5)+2(E4)\text{ (not considering the camber of the last).}$$

$$(E9)=R+(E7)+2(E5)+2(E4)\text{ (not considering the camber of the last).}$$

From FIG. 4 one finds how to locate the lower line of the region D-D', it is a region which defines a curvature symmetrical to the curvature of the metatarsal heads of the toes, a point at which intersect the central line of the last with the form of the curvature, designated as K or P3, two points known as P1 and P4 that define the points on the curve D closest to the lateral walls of the last in the zone of the first and fifth metatarsal, lines running toward the lower part on the edge of the sole known as P and C, the joining of these two points P and C by a junction line determines the length of the last to calculate that of the toe cap.

The next step is to determine the line of the axis of the last, for which one traces a point tangential to the heel of the last (TT) and also traces a point tangential to the tip of the last (PT), a junction line is drawn between TT and PT (FIG. 4), which determines the line of the axis of the last in combination with the line of width of the toe cap one can determine the external (PE), central (PC) and internal (PI) depths (as shown in FIG. 4).

Next, this line PC is divided by 4 to obtain the points of reference for measurement of the external depth of the last for the toe cap, the central depth of the last for the toe cap and the internal depth of the last for the toe cap, said points being known as X1, X2 and X3, see FIG. 4.

In a manner parallel to the axis of the last, one draws lines from X1, X2, X3 to the limit points of the tip of the last on the plantar base Y1, Y2 and Y3, forming in this way the lines which define the following depths of the last with respect to the toe cap:

External depth of the last, the distance measured on the last from X1 to Y1

Central depth of the last, the distance measured on the last from X2 to Y2

Internal depth of the last, the distance measured on the last from X3 to Y3

Then:

$$PEH=\text{External depth of the last.}=X1-Y1$$

$$PCH=\text{Central depth of the last.}=X2-Y2$$

$$PIH=\text{Internal depth of the last.}=X3-Y3$$

Ib. The Depths of the Toe Cap are Determined by the Following Formulas:

PEC=External depth of the toe cap with respect to its internal arch.

PCC=Central depth of the toe cap with respect to its internal arch.

PIC=Internal depth of the toe cap with respect to its internal arch.

Then:

$$PEC=PEH+E5$$

$$PCC=PCH+E5$$

$$PIC=PIH+E5$$

Ic. Determination of the Length of the Heel

One determines the tangential point of the outer shank of the last, once this point is determined one takes a flexible tape and runs a parallel line "T" and marks this line on the last, at the same time taking its length; once the line "T" is drawn, this length is divided by 3, as shown in FIG. 4, in this way one obtains an auxiliary value T/3 for determining the lines of flexing of the toes.

Id. Determination of the Point A or Mouth Height

Figure 2B:
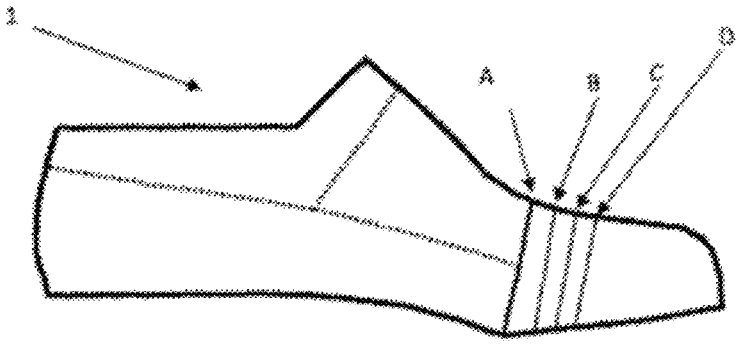
FIG. 2B is a schematic lateral elevation view of the last on which the different measurement lines and references are traced to design and calculate the toe cap of the present invention.

Once the inner and outer tangential points of the last are determined in the zone of the tip, one passes a measuring tape around the body of the last and determines the point "A" at the intersection of the central axis line (10), as shown in FIGS. 1A, 2B and 4.

Ie. Determination of the Point B

Starting from point "A" and on the central axis line one adds the value of T/3 to this new measurement, it is known as the point "B", this determination is based on the golden proportion criteria of the morphology of the foot (see FIGS. 2A, 2B and 4).

If. Determination of the Point C

Once point B is determined, 5 mm are added to the central axis line (10), FIGS. 1A and 4. The criterion of the 5 mm added has been determined as the result of the location of the flexure zone of the foot, translated to the last. This determines the point C, where is located the line of flexure of the toes, translated to the last (FIGS. 2A and 2B).

Ig. Determination of the Point D

In the process of construction where the protective tip is used, one uses the element known as a tab, which is a strip of synthetic material consisting of two parts, one being inserted inside the edge or mouth of the toe cap and having a small step of 1 mm thickness and a width of 10 mm; toward the outer part of the strip it has a measurement of 10 mm and in total the tab strip has a width of 20 mm.

To determine the point D, it is important to measure this so-called tab element at two specific points, namely, the interior flange (18) and the exterior flange or rim (11), in this case the tab being used has a dimension of 8 to 10 mm (x).

Considering that the distance A-D is the zone of flexure of the toes, the distance to be added in the central axis line (10) after the point (C) is equal to the outer width, that is, the distance of (C) (all those of FIGS. 2A and 2B), to this is added 8 to 10 mm and it gives us the point P3 of the curve (D) (FIG. 1A).

Ih. Determination of Width and Height for the Design of the Toe Cap

We have already explained, starting from the last, the definition and position of the form and position of the curve point "D", now making a longitudinal cut from position "D" we obtain the following image FIG. 3.

Ii. Definition of Angles of the Toe Cap

FIG. 6 shows the angle α which defines the angle between the maximum height point of the region "D" and the line of support of the flange, said angle corresponds to 20 degrees, this enables an additional stability of the toe cap, giving it antiroll properties and greater dispersion of forces in the impact and compression tests.

In FIG. 7 one observes the angle β, which is formed with respect to a straight line from the inside width points of the toe cap between the inside and outside point equivalent to 5 degrees as the resultant of the coverage for the 1st and 5th digits, which provides a larger coverage for the fifth digit.

What is claimed is:

1. A method for making safety and protection footwear containing a safety toe cap comprising:

first performing an anthropometric study of a specific worker's foot to determine dimensions of the toes of said specific worker and zone of flexure of the toes of said specific worker;

then statistically analyzing the determined dimensions;

then translating the determined dimensions to three-dimensional measurements;

then making a last in accordance with said three-dimensional measurements obtained;

then making the specific worker's safety toe cap in a single piece that has a rim from the last;

said rim characterized by a curvature (D-D') which includes points P1, P2, P3, P4, wherein a mathematical formulas for the computation of measurements the P1 to the P4 of said curvature (D-D') are for men:

$P1=K-(0 \text{ to } 7 \text{ mm});$ $P2=K+(0 \text{ to } 6 \text{ mm});$ $P3=K;$ $P4=K-(1 \text{ to } 2 \text{ mm});$ and for women:

$P1=K-(2 \text{ to } 7 \text{ mm});$ $P2=K-(1 \text{ to } 3 \text{ mm});$ $P3=K;$ $P4=K+(2 \text{ to } 7 \text{ mm});$ where the K is a constant that defines a point coinciding with a central line of said last and with a central line of the curvature of said toe cap and is a distance to A–P3 that is equal to ⅓ of T+5 mm+10 mm wherein;

the T is a width of a heel of said last;

the P1 is a point on a curve of said toe cap closest to a line of descent on the lateral wall to a first digit on said last;

the P2 is a maximum point of curvature most pronounced toward the curvature of said last;

the P3 is a distance at which the curvature of said toe cap coincides with a central axis of said last;

the P4 is a point closest to a line of descent to a zone of the 5th digit or external line of said last; and, inserting said specific worker's safety toe cap into said safety and protection footwear that protects all five toes of said specific worker's foot while allowing the toes of said specific worker to flex freely in said zone of flexure of the toes of said specific worker.

2. The method of claim 1 wherein said specific worker's safety toe cap is designed for the specific morphology of said specific worker's foot, wherein the morphology includes foot/shoe size, the anatomical distribution of the heads of the metatarsals, as well as gender.

3. The method of claim 1 wherein a width of said specific worker's safety toe cap is provided by the results of the anthropometric study.

4. The method of claim 1 where in the dimensions of the specific worker's toes are obtained by performing a three-dimensional scan of specific worker's foot.

5. The method of claim 4 wherein the dimensions are translated for three-dimensional evaluation of the specific worker's toes.

6. The method of claim 5 wherein the measurements are statistically analyzed to determine trends of measurements and obtain the measurements for the population segment studied.

7. The method of claim 1 wherein the location of metatarsal heads of the five toes of the specific worker is determined.

8. The method of claim 7 wherein a line formed by the location of points of-the said metatarsal heads forms a curvature of a top of the specific worker's safety toe cap.

9. A method for calculating dimensions of a safety and protection footwear protective toe cap wherein the specific worker's safety toe cap is for protecting the five toes of a specific worker while still allowing comfortable walking by using toe dimensions of population segments measured by a three-dimensional scanning system wherein said dimensions have been translated by means of an adapter to a dimension evaluation system resulting in three-dimensional toe dimensions and wherein statistical analysis has been conducted on a three-dimensional measurements and determining trends of said three-dimensional measurements resulting in representative three-dimensional measurements for the population segments and using said representative three-dimensional measurements to construct an image replicating an exact image of a tip of a last having a plantar base with the dimensions of a predetermined depth comprising:

determining a width of said specific worker's safety toe cap directly by first performing an anthropometric study of a specific worker's foot to determine dimensions of said specific worker's five toes and zone of flexure of the five toes of said specific worker and translating onto the last the location of metatarsal heads of the five toes then locating the internal and external fibular lengths of the last then generating points using said internal and external fibular lengths and then joining said points together to determine a curved line;

then projecting said points on said curved line to the plantar base of said last with an angle of inclination determined to cover said five toes without causing rubbing and providing greater stability to said protective toe cap;

then establishing two additional points on the plantar base of the last; joining by a straight line said two additional points, whereby determining the width of said last for said protective toe cap wherein the width of said last determines the width of said protective toe cap;

then attaching an interior lining to said last and adding to said width of said last twice the thickness of said interior lining attached to said last and twice the thickness of an alignment tab attached to said specific worker's safety toe cap resulting in the width of said specific worker's safety toe cap allowing insertion of said specific worker's safety toe cap in said safety and protection footwear;

making said specific worker's safety toe cap in a single piece that has a rim from the last;

said rim characterized by a curvature (D-D') which includes points P1, P2, P3, P4, wherein a mathematical formulas for the computation of measurements the P1 to the P4 of said curvature (D-D') are for men:

$P1=K-(0 \text{ to } 7 \text{ mm});$ $P2=K+(0 \text{ to } 6 \text{ mm});$ $P3=K;$ $P4=K-(1 \text{ to } 2 \text{ mm});$ and for women:

$P1=K-(2 \text{ to } 7 \text{ mm});$ $P2=K-(1 \text{ to } 3 \text{ mm});$ $P3=K;$ $P4=K+(2 \text{ to } 7 \text{ mm});$ where the K is a constant that defines a point coinciding with a central line of said last and with a central line of the curvature of said toe cap and is a distance to A–P3 that is equal to ⅓ of T+5 mm+10 mm wherein;

the T is a width of a heel of said last;

the P1 is a point on a curve of said toe cap closest to a line of descent on the lateral wall to a first digit on said last;

the P2 is a maximum point of curvature most pronounced toward the curvature of said last;

the P3 is a distance at which the curvature of said toe cap coincides with a central axis of said last;

the P4 is a point closest to a line of descent to a zone of the 5th digit or external line of said last; and inserting said specific worker's safety toe cap into the safety and protection footwear that protects all five toes of the specific worker's foot while allowing the toes of said specific worker to flex freely in said zone of flexure of the toes of said specific worker.

10. The method of claim 9 wherein the method further comprises:

verifying the determined width of said specific worker's safety toe cap with the width of said last;

designing a support base for said specific worker's safety toe cap wherein the support base are no flange, half flange, and complete flange; and, developing an electronic design program for the design in a numerical control center.

* * * * *